US010182295B2

(12) United States Patent
Gu et al.

(10) Patent No.: US 10,182,295 B2
(45) Date of Patent: Jan. 15, 2019

(54) VIBRATION DIAPHRAGM

(71) Applicant: AAC Technologies Pte. Ltd., Singapore (SG)

(72) Inventors: Xiaojiang Gu, Shenzhen (CN); Lei Wang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/828,880

(22) Filed: Dec. 1, 2017

(65) Prior Publication Data

US 2018/0367914 A1 Dec. 20, 2018

(30) Foreign Application Priority Data

Jun. 20, 2017 (CN) ..... 2017 2 0723806 U

(51) Int. Cl.

| | |
|---|---|
| ***H04R 9/06*** | (2006.01) |
| ***H04R 7/18*** | (2006.01) |
| ***H04R 9/02*** | (2006.01) |
| ***H04R 7/12*** | (2006.01) |
| ***H04R 7/14*** | (2006.01) |

(52) U.S. Cl.

CPC ..... *H04R 7/18* (2013.01); *H04R 7/127* (2013.01); *H04R 7/14* (2013.01); *H04R 9/02* (2013.01); *H04R 9/06* (2013.01); *H04R 2207/021* (2013.01); *H04R 2307/207* (2013.01)

(58) Field of Classification Search

CPC . H04R 7/04; H04R 7/06; H04R 7/127; H04R 7/14; H04R 7/18; H04R 9/02; H04R 9/06; H04R 2207/021; H04R 2307/207

USPC ..... 381/353, 398, 423, 424, 426, 430, 431; 181/157, 163, 164, 167

See application file for complete search history.

(56) References Cited

U.S. PATENT DOCUMENTS

| | | | | |
|---|---|---|---|---|
| 7,801,324 | B2 * | 9/2010 | Kimura | H04R 9/06 381/423 |
| 8,379,907 | B2 * | 2/2013 | Yan | H04R 7/04 381/396 |
| 9,386,377 | B2 * | 7/2016 | Xiao | H01F 7/0289 |
| 2007/0053547 | A1 * | 3/2007 | Ando | H04R 9/06 381/430 |

* cited by examiner

*Primary Examiner* — Huyen D Le

(74) *Attorney, Agent, or Firm* — Na Xu; IPro, PLLC

(57) ABSTRACT

The present disclosure provides a vibration diaphragm. The vibration diaphragm includes a dome part; a suspension surrounding the dome part; a number of reinforced ribs disposed on the dome part. The reinforced ribs includes n pieces of longitudinal rib parts parallel to each other; a first transverse rib part and a second transverse rib part connecting two ends of adjacent n−1 pieces of the longitudinal ribs respectively; and a third transverse rib part connecting the n pieces of longitudinal rib parts and located between the first transverse rib part and the second transverse rib part, in which, n is an integer more than or equal to 3. The configuration of the reinforced ribs increases the surface area of the dome, and increases the width of the vibration frequency band of the vibration diaphragm.

5 Claims, 2 Drawing Sheets

VIBRATION DIAPHRAGM

FIELD OF THE PRESENT DISCLOSURE

The present disclosure relates to electro-acoustic transducers, more particularly to a vibration diaphragm for radiating audible sounds.

DESCRIPTION OF RELATED ART

With the rapid development of portable devices like mobile phone etc, people's requirement to the performance of the product is becoming stronger and stronger, and there is a vibration mode of music belt for the music appreciation of the mobile phone, in order to strengthen the entertaining effect, thus, the development of the sounding instrument is accelerating accordingly.

The sounding instrument with relevant technology comprises a frame, a vibration diaphragm supported on the frame and a voice coil driving the vibration of the vibration diaphragm. The vibration diaphragm comprises a dome and a suspension extending along the dome, and the voice coil is fixed on the suspension.

However, in the vibration diaphragm with relevant technologies, the dome is a simple plane structure, and this structure makes the acoustic performance of the vibration diaphragm not improved further, and affects badly the acoustic performance of the vibration diaphragm.

Therefore it is necessary to provide an improved vibration diaphragm for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
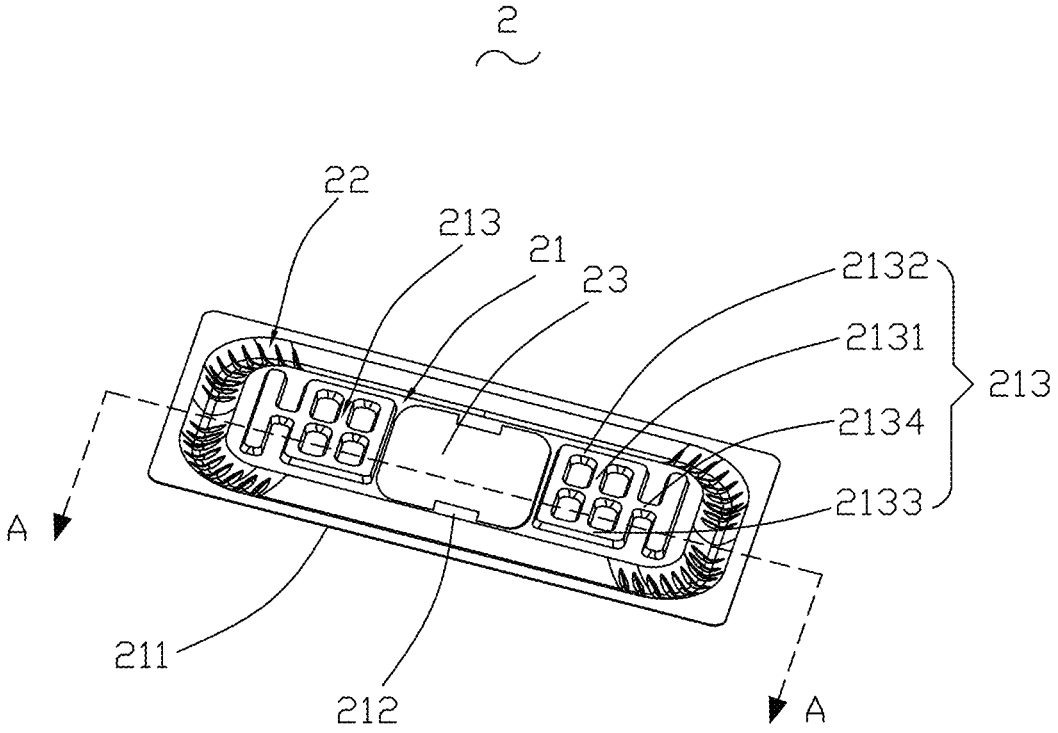
FIG. 1 is an illustrative isometric view of a vibration diaphragm in accordance with an exemplary embodiment of the present disclosure.
Figure 2:
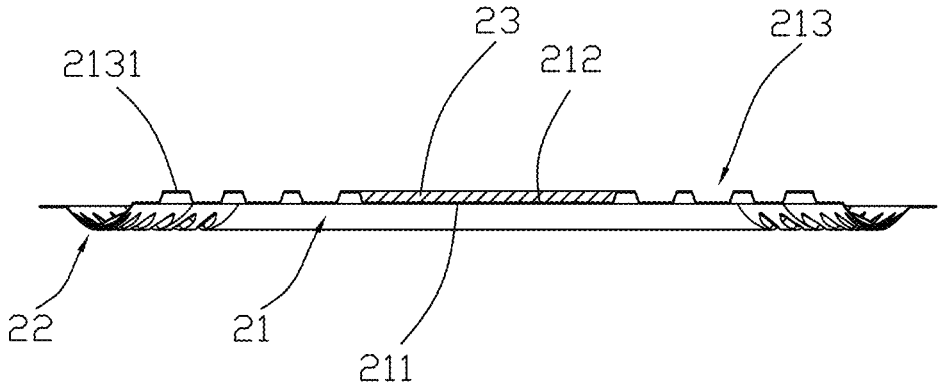
FIG. 2 is a cross-sectional view of the vibration diaphragm in FIG. 1, taken along line A-A.

Referring to FIGS. 1-2, the present disclosure provides a vibration diaphragm 2, and the vibration diaphragm 2 comprises a dome part 21 with a flat structure, a suspension 22 surrounding the dome part 21, and a reinforced plate 23 arranged on the dome part 21.

The dome part 21 comprises a bottom surface 211, a top surface 212 opposite to the bottom surface 211, and a plurality of reinforced ribs 213.

The reinforced ribs 213 are disposed on the bottom surface 211 and/or the top surface 212. The reinforced ribs 213 comprise n pieces of longitudinal rib parts 2131 parallel to each other, a first transverse rib part 2132 and a second transverse rib part 2133 connecting two ends of adjacent n−1 pieces of the longitudinal ribs 2131 respectively, and a third transverse rib part 2134 connecting the n pieces of longitudinal rib parts 2131 and located between the first transverse rib part 2132 and the second transverse rib part 2133. Be noted that n is an integer more than or equal to 3.

In this embodiment, the reinforced ribs 213 comprises 4 pieces of longitudinal rib parts 2131, a first transverse rib part 2132 and a second transverse rib part 2133 connecting two ends of adjacent 3 pieces of described longitudinal ribs 2131 respectively, and a third transverse rib part 2134 connecting the 4 pieces of longitudinal rib parts 2131 and located between the first transverse rib part 2132 and the second transverse rib part 2133.

Notably, the first transverse rib part 2132, the second transverse rib part 2133 and the third transverse rib part 2134 are reinforced rib structures in parallel with the direction of the long axis of the vibration diaphragm 2, and the longitudinal rib part 2131 is a reinforced rib structure in parallel with the direction of the short axis of the vibration diaphragm 2, i.e., the vibration diaphragm 2 is rectangular.

In this embodiment, the intervals between two adjacent described longitudinal rib parts 2131 are equal. The third transverse rib part 2134 connects the middle part of n pieces of described longitudinal rib parts 2131.

The structure of above described reinforced rib 213 can increase the surface area of the dome part 21, and widen the frequency band of the vibration diaphragm 2, in order to improve the sensitivity of the vibration diaphragm 2, and optimize the acoustic performance of the vibration diaphragm 2.

In order to protect the balanced performance while the vibration diaphragm 2 is vibrating, the reinforced rib 3 has a central symmetrical structure.

Preferably, in this embodiment, there are two groups of the reinforced ribs 213, and the two groups are spaced on the dome part 21 symmetrically. Preferably, the two groups are symmetrical about a short axis of the vibration diaphragm 2, which optimizes the balance of the vibration diaphragm 2 while vibrating.

The configuration of the reinforced ribs 213 can improve the strength of the dome part 1, i.e.: improve the reliability of the vibration diaphragm 2. Certainly, various structures between the whole described reinforced ribs 213 are supported mutually, while strengthening the structure intensity.

The suspension 22 provides flexible deformation of the dome part 21, and strengthens the vibration intensity of the dome part 21, and improves the acoustic performance of the vibration diaphragm 2.

In this embodiment, the cross section of the suspension 22 is an arc depressing towards the bottom surface 211 from the top surface 212.

The reinforced plate 23 is fixed on the dome part 21, and the reinforced plate 23 is clamped and set between two described reinforced ribs 213, in order to make two described reinforced ribs 213 symmetrical about the reinforced plate 23, i.e.: comparing with the vibration with relevant technology, the structure of the dome 23 is reduced, in order to reduce the mass of the vibration diaphragm 2, and widen the frequency band and improve the sensitivity.

Figure 3:
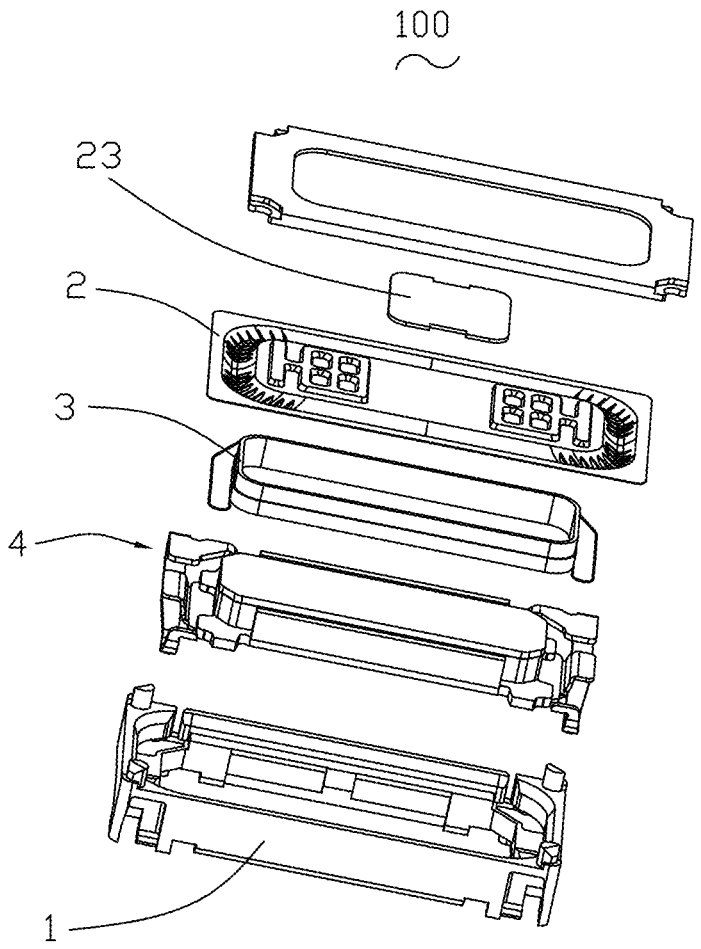
FIG. 3 is an exploded view of a sound generator using the vibration diaphragm in FIG. 1.

Please refer to FIG. 3, the present disclosure provides a sound generator 100, and the sound generator 100 comprises the above-described vibration diaphragm 2.

Specifically, the sound generator 100 includes a frame 1, a vibration diaphragm 2 fixed and supported on the frame 1, a voice coil 3 driving the vibration and sounding of the vibration diaphragm 2 and a magnetic circuit system 4 fixed on the frame 1.

Comparing with the existing technologies, the vibration diaphragm provided by the present disclosure forms reinforced ribs with rough structure in its dome, and the configuration of the reinforced ribs increases the surface area of the dome, and increases the width of the vibration frequency band of the vibration diaphragm, and improves the sensitivity of the vibration diaphragm, in order to optimize the acoustic performance of the sounding instrument using the vibration diaphragm, as well as the acoustic performance of an electronic equipment using the sounding instrument.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A vibration diaphragm comprising:

a dome part;

a suspension surrounding the dome part;

a plurality of reinforced ribs disposed on the dome part;

the reinforced ribs comprising n pieces of longitudinal rib parts parallel to each other;

a first transverse rib part and a second transverse rib part connecting two ends of adjacent n−1 pieces of the longitudinal ribs respectively;

a third transverse rib part connecting the n pieces of longitudinal rib parts and located between the first transverse rib part and the second transverse rib part; wherein n is an integer more than or equal to 3.

2. The vibration diaphragm as described in claim 1, wherein the third transverse rib part connects the middle parts of the n pieces of longitudinal rib parts.

3. The vibration diaphragm as described in claim 1 comprising two groups of reinforced ribs arranged on the dome part symmetrically.

4. The vibration diaphragm as described in claim 3 further comprising a reinforced plate located on the dome part and located between the two groups of reinforced ribs.

5. A sound generator comprising:

a frame;

a vibration diaphragm as described in claim 1 being fixed and supported by the frame;

a voice coil for driving the vibration diaphragm.

* * * * *